US006559398B2

(12) United States Patent
Takeda et al.

(10) Patent No.: US 6,559,398 B2
(45) Date of Patent: May 6, 2003

(54) ROCKER-TYPE POWER-SUPPLY SWITCH DEVICE

(75) Inventors: Masayuki Takeda, Miyagi-ken (JP); Toshiharu Mori, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/836,853

(22) Filed: Apr. 17, 2001

(65) Prior Publication Data

US 2002/0011404 A1 Jan. 31, 2002

(30) Foreign Application Priority Data

Apr. 18, 2000 (JP) ..... 2000-122383

(51) Int. Cl.[7] ..... H01H 23/02
(52) U.S. Cl. ..... 200/339; 200/295; 200/302.3
(58) Field of Search ..... 200/293, 295, 200/296, 302.1–302.3, 339

(56) References Cited

U.S. PATENT DOCUMENTS 4,937,407 A * 6/1990 Osika ..... 200/302.3
5,512,717 A * 4/1996 Magome et al. ..... 200/295
6,025,565 A * 2/2000 Miyase et al. ..... 200/61.28
6,103,981 A 8/2000 Kremer ..... 200/339

* cited by examiner

*Primary Examiner*—J. R. Scott
(74) *Attorney, Agent, or Firm*—Brinks Hofer Gilson & Lione

(57) ABSTRACT

A switch device includes a first case and a second case. Stationary contacts are enclosed within the first case that is sealed by a cover. An operating lever configured to actuate a movable contact is partially received by a window hole within the cover. An engaging hook is unitary part of or is coupled to the outside surface of the second case. Stationary terminals project from the stationary contacts. The second case encloses the first case and the cover. The first case and the cover are made of resins having an arc resistance. The second case is made of a thermoplastic resin that is more flexible than the first case.

6 Claims, 7 Drawing Sheets

ROCKER-TYPE POWER-SUPPLY SWITCH DEVICE

BACKGROUND

1. Field of the Invention

The present invention relates to a switch, and more particularly, to a seesaw-type power-supply switch.

2. Description of the Related Art

To mount some conventional switches to power supplies, the conventional switches engage an outer case of the power supplies through hooks. These hooks can be made of a flexible material, such as thermoplastic resin. When arc resistance is needed, the switch case can be made of a thermosetting resin. In some designs, the hooks are made of plate materials that connect to the switch case.

When a thermosetting resin is used, the hook, in some instances, is made separately from the switch case. In these switches, many parts may be needed and these parts may be difficult to assemble. Accordingly, there is a need for an easily assembled switch that has an arc resistance.

SUMMARY

In one aspect of the invention, a switch comprises a first case and a second case. The first case has an accommodating portion that receives a stationary contact and a movable contact. A cover, having a window hole, is supported by a top portion of the first case. An operating lever that includes a portion passing through the window hole operates a movable contact. The movable contact mechanically couples and separates from a stationary contact. At an outside portion of the second case, a hook such as an engaging hook, and a stationary terminal project from the first case. The first case and the cover are received by the second case. In this aspect, the first case and the cover are comprised of an arc resistance resin. The second case is comprised of a thermoplastic resin. Preferably, the second case is more flexible than the first case. Furthermore, the stationary terminal is secured to the second case through a receiving hole by a press fitting. Preferably, the receiving hole passes through an inside bottom portion of the first case.

In a second aspect, a contact section, which comprises the stationary contact and the movable contact, is enclosed by the first case and the cover. An outside surface of the first case and an inside surface of the second case comprise a preventing means. A recess formed within an outside side surface of the first case, and a protrusion projecting from the inside surface of the second case preferably comprise the preventing means.

In another aspect, the switch comprises a protruding step which is positioned near an inside bottom surface of the second case. The protruding step is disposed near a hole configured to receive the stationary terminal. Preferably, a through hole passes through the inside bottom portion of the first case. The through hole is positioned to receive the protruding step. In this aspect, the stationary terminal is positioned within the switch by bringing a bottom surface portion of the stationary terminal into contact with the protruding step. In another aspect, the first case and the second case is positioned by fitting the protruding step through the through hole.

DESCRIPTION OF THE PRESENTLY PREFERRED EMBODIMENTS

Referring to FIGS. 1–12, a first case 1 is comprised of an insulating material, that preferably includes a plastifiable PPS (polyphenylene sulfide) having an arc resistance and a thermosetting resin such as unsaturated polyester. Preferably, the plastifiable PPS has a high arc resistance.

Figure 3:
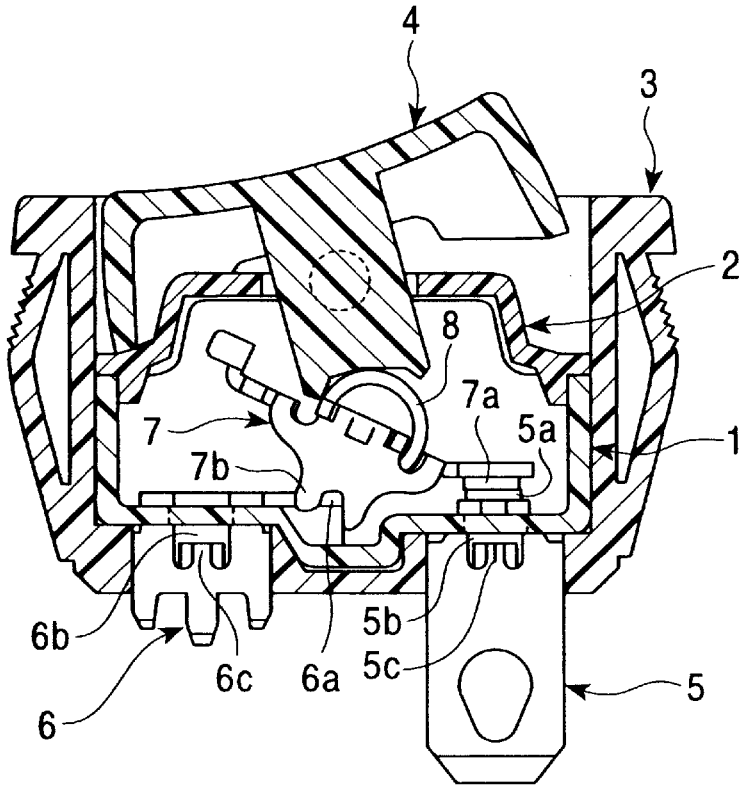
FIG. 3 is a sectional view taken along lines III—III of FIG. 2.
Figure 4:
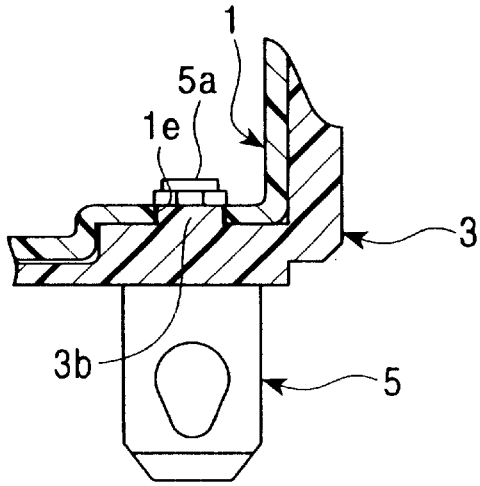
FIG. 4 is a sectional view taken along line IV—IV of FIG. 2.
Figure 7:
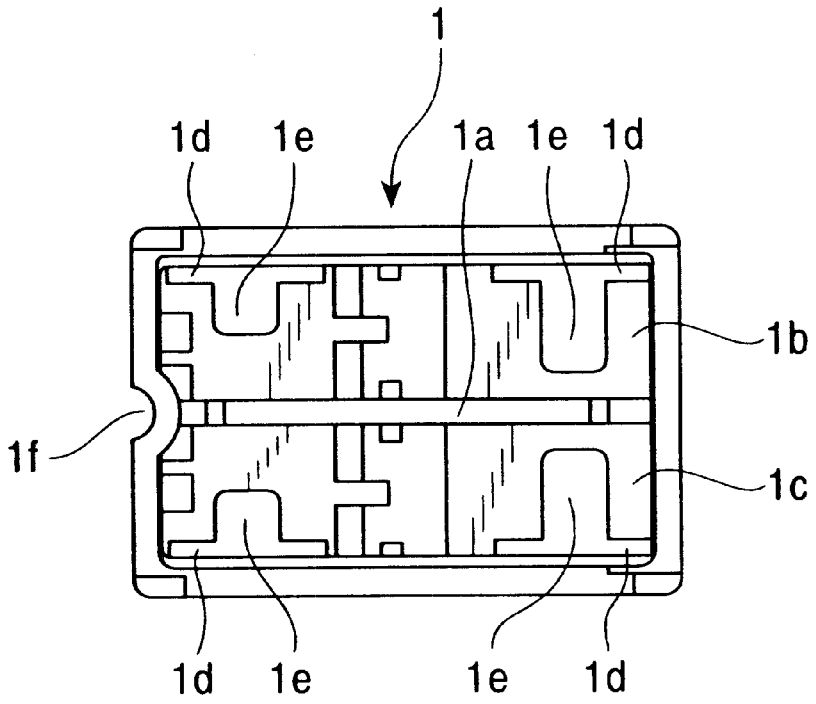
FIG. 7 is a plan view of a first case.
Figure 8:
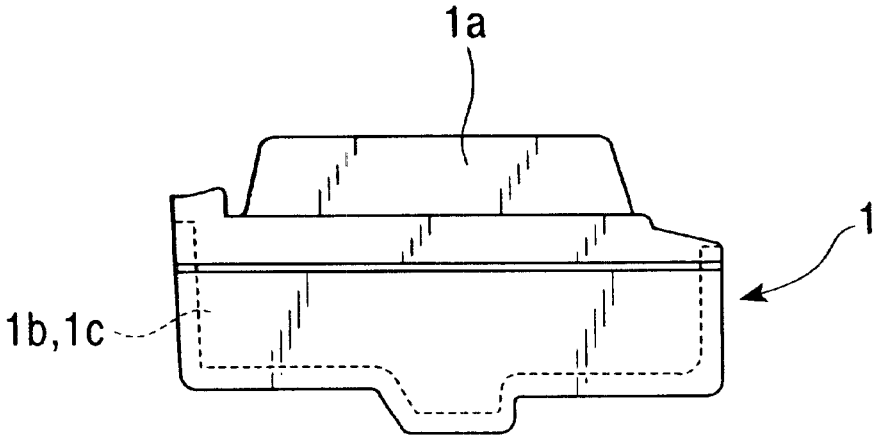
FIG. 8 is a front view of the first case.

The first case 1 includes an open topside. As shown in FIG. 7, preferably an interior portion of the first case 1 is separated into two accommodating portions 1*b* and 1*c* by an insulating wall 1*a*. A pair of substantially rectangular slot-shaped receiving holes 1*d* are positioned near the corners of the first case 1. The substantially rectangular slot-shaped receiving holes 1*d* are configured to receive stationary terminals 5 and 6 that are shown in FIG. 3. The stationary terminals 5 and 6 are positioned in an interior bottom portion of the accommodation portions 1*b* and 1*c*. Preferably, the substantially rectangular slot-shaped receiving holes 1*d* are positioned across from each other. A pair of substantially rectangular or polygon shape through holes 1*e* are formed adjacent to each through hole 1*d*. These pairs of receiving holes 1*d* and through holes 1*e* are preferably positioned across from each other. As partially shown in FIG. 4, protruding steps 3*b* pass through and engage the inner peripheral surfaces of the corresponding through holes 1*e*.

Figure 5:
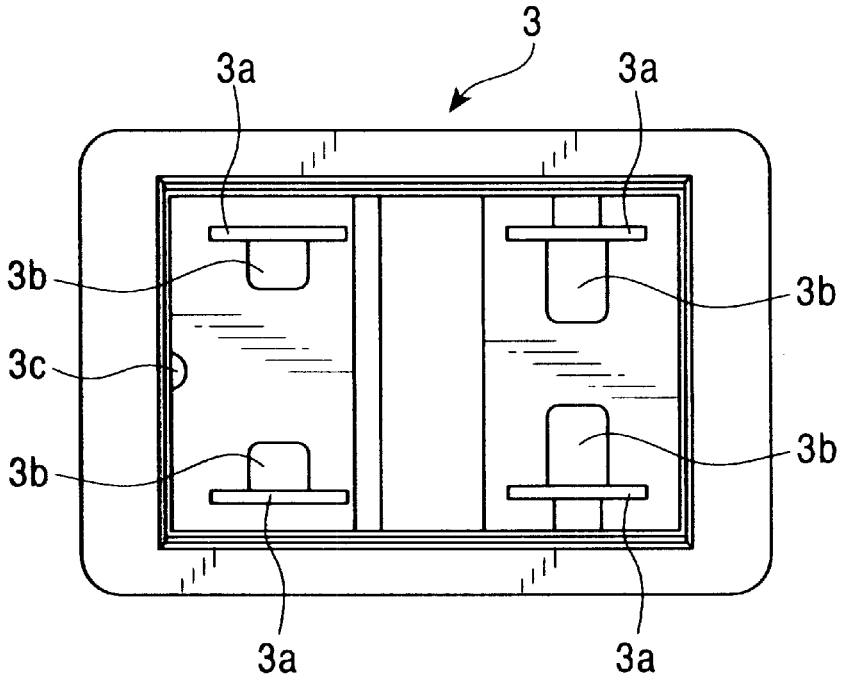
FIG. 5 is a plan view of a second case.

As shown in FIG. 7, preferably, a recess 1*f* is formed in an outer surface end of the first case I. The recess 1*f* is configured to receive a protrusion 3*c* (as shown in FIG. 5) which comprises an arc formed within an inside surface of the second case 3. In this embodiment, when the protrusion 3*c* and recess 1*f* are not in alignment, the first case 1 does not seat within the second case 3. This misalignment prevents the first case 1 from being properly coupled to the second case 3. Preferably, this misalignment is easily identified.

Figure 9:
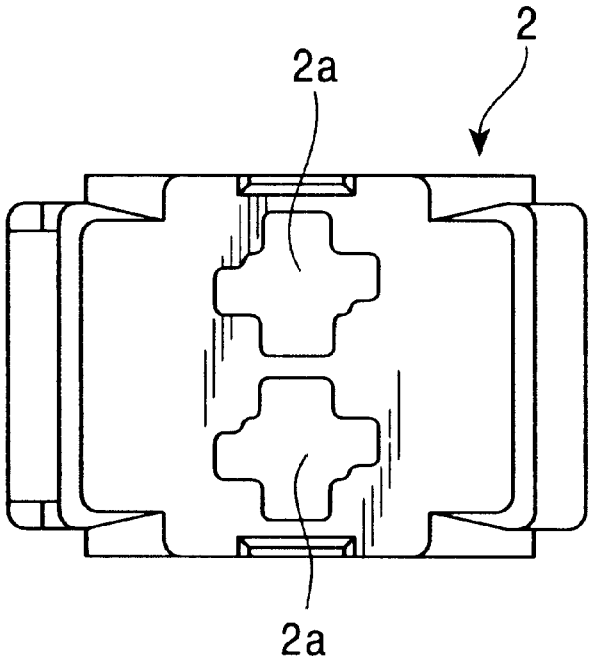
FIG. 9 is a plan view of a cover.
Figure 10:
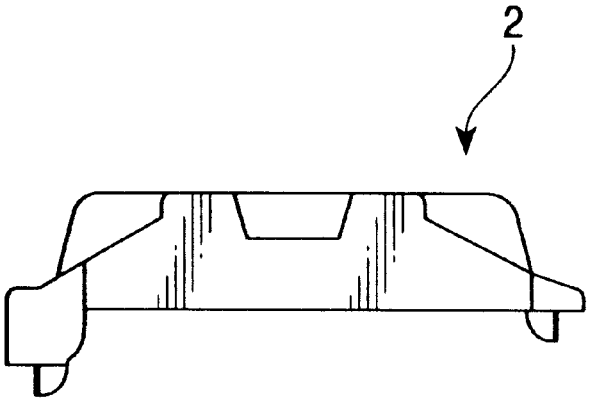
FIG. 10 is a front view of the cover.
Figure 11:
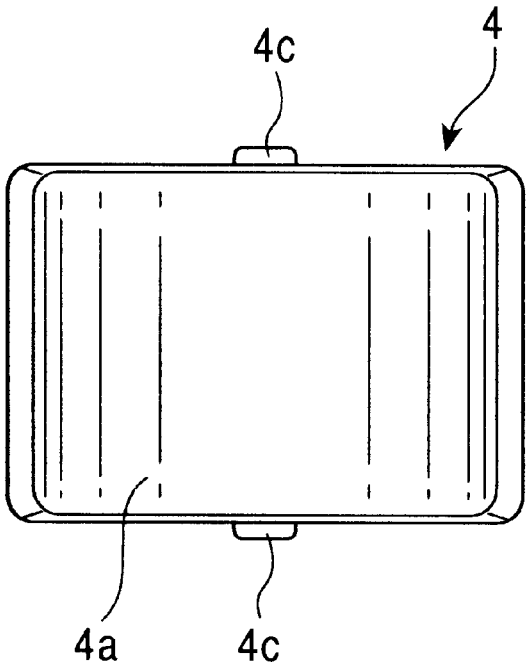
FIG. 11 is a plan view of an operating lever.
Figure 12:
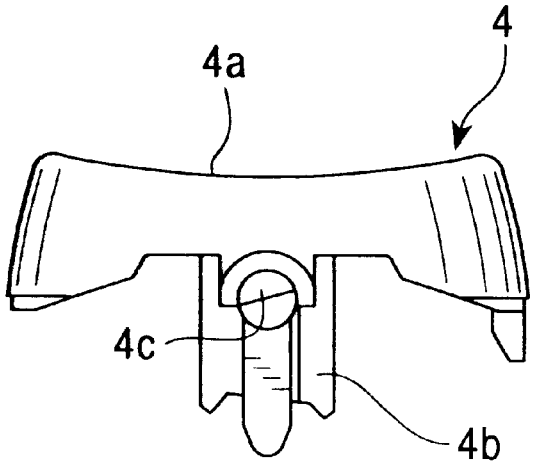
FIG. 12 is a front view of the operating lever.

Preferably, a cover 2 (as shown in FIG. 9) comprises an insulating material such as a plastifiable PPS (polyphenylene sulfide) having an arc resistance and a thermosetting resin such as unsaturated polyester. Preferably, the cover 2 has a substantially multisided shape and an open bottom side. As shown in FIG. 9, a pair of cross-shaped window holes 2*a* pass through the cover 2. An actuating portion 4*b* of an operating lever 4 shown in FIG. 12, passes through the pair of window holes 2*a*.

The cover 2 engages a top wall portion of the first case 1 to conceal the open portion of the first case 1. The first case 1 and the cover 2 are preferably configured to cover a contact section that comprises first and second stationary contacts 5*a* and 6*a*, respectively, and a movable contact 7 as shown in FIG. 3. In this embodiment, the contact section of the switch is protected by the cover 2 and the first case 1, which preferably comprises resins having high arc resistances.

Figure 6:
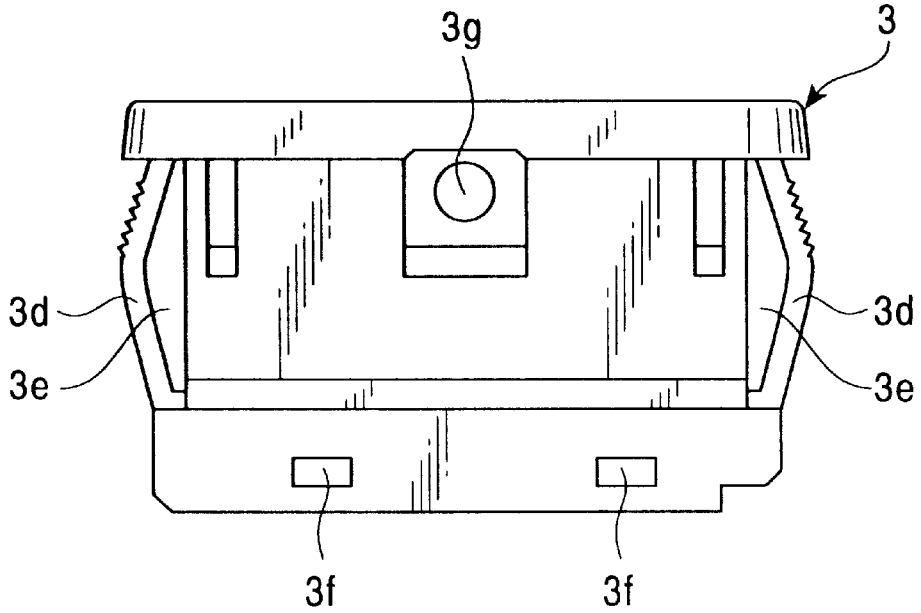
FIG. 6 is a front view of the second case.

Preferably, the second case 3 is made of an insulating material, such as polyacetals and polyamides, which are thermoplastic resins that are more flexible than the first case 1. Preferably, the second case 3 has a substantially parallelepiped shape having an open top side, as shown in FIG. 6. Two pairs of slot-shaped or polygonal shaped holes 3*a* for receiving the stationary terminals 5 and 6 pass through an inner bottom surface of the second case 3 shown in FIG. 5. The holes 3*a* are positioned across from each other. Two pairs of substantially rectangular or polygon shaped protruding steps 3*b* are formed near the holes 3*a*. The protruding steps 3*b* are positioned across from each other, and preferably pass through and engage the corresponding through holes 1*e* of the first case 1. In this embodiment, the height of the protruding steps 3*b* are preferably slightly greater than the depths of the through holes 1*e*. The preferred heights of the protruding step 3*b* ensure that the protruding steps 3*b* pass through the corresponding through holes 1*e*. Preferably, the dimensions of the protruding step 3*b* allows the stationary terminals 5 and 6 that are secured to the holes 3*a* of the second case 3 to couple the protruding steps 3*b*. Accordingly, the stationary terminals 5 and 6 are mechanically coupled to the second case. Preferably, the protrusion 3*c* of the second case 3 is configured to engage the recess 1*f* of the first case 1. Preferably, the protrusion 3*c* is a unitary part of a side surface within the open portion of the second case 3. The protrusion 3*c* engages the recess 1*f* when the first case 1 is properly received by the second case 3. Preferably, the configuration of the outside surface of the first case 1 and the inside surface of the second case 3 prevents an improper assembly of the switch. If the first case 1 is improperly inserted within the second case 3, the recess 1*f* and the protrusion 3*c* will not engage each other and the first case 1 will not substantially seat within the second case 3. Accordingly, when the first case 1 has not been properly inserted within the second case 3, a misalignment is easily detected. The structure that prevents the first case 1 from being improperly inserted within the second case 3 is not limited to a recess and a protrusion because many other suitable structures may also be used.

As shown in FIG. 6, a hook, such as a preferred snap engaging hook 3*d*, for example, is a unitary part of or couples to a side or a front surface of the exterior of the second case 3. Preferably, the hook 3*d* is made of a thin-plate material that terminates at ends coupled to or joined to the exterior surface of the second case 3. Preferably, the hook 3*d* is flexible, and encloses a substantially triangular or polygonal-shaped opening. The hook is preferably configured to snappingly engage devices, such as electronic devices.

Figure 1:
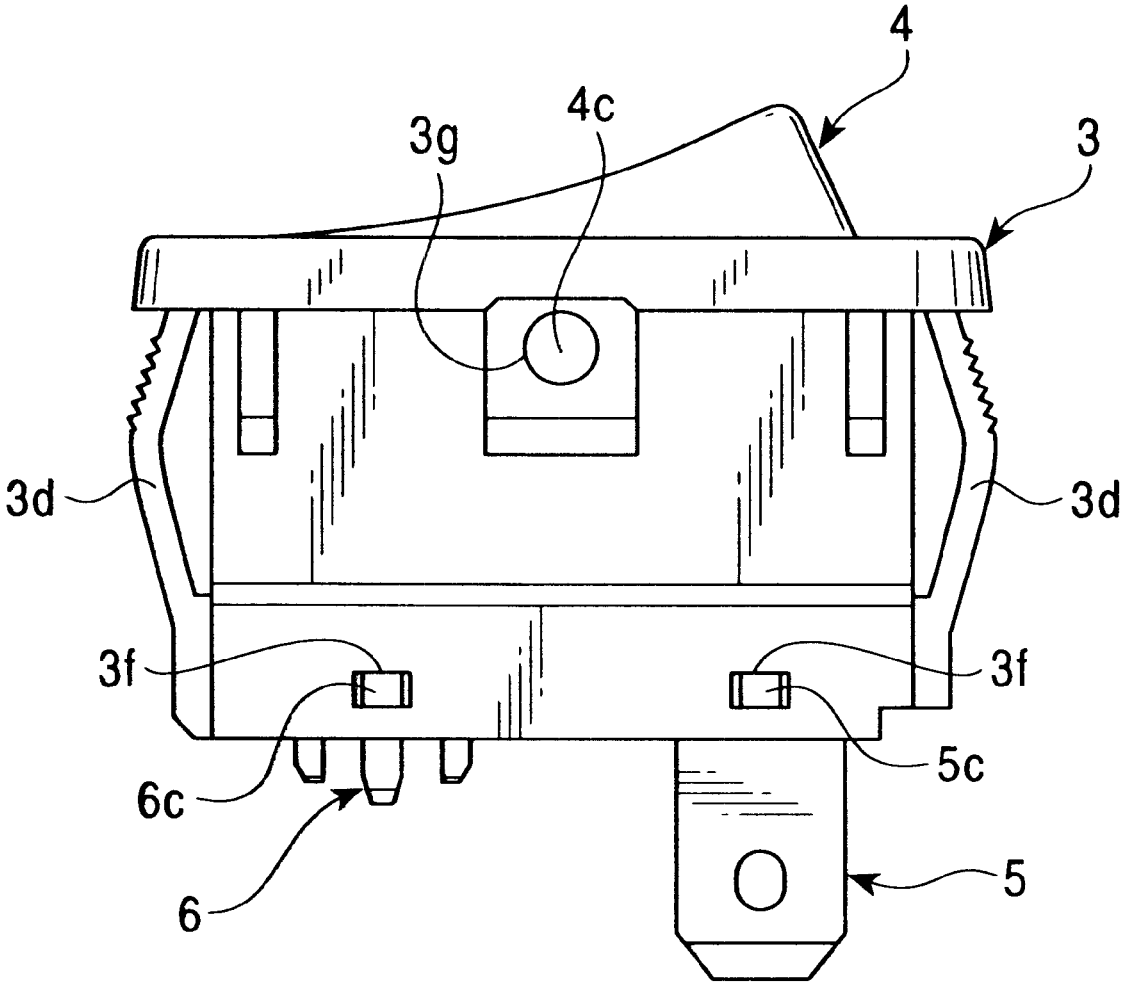
FIG. 1 is a front view of an embodiment of the invention.
Figure 2:
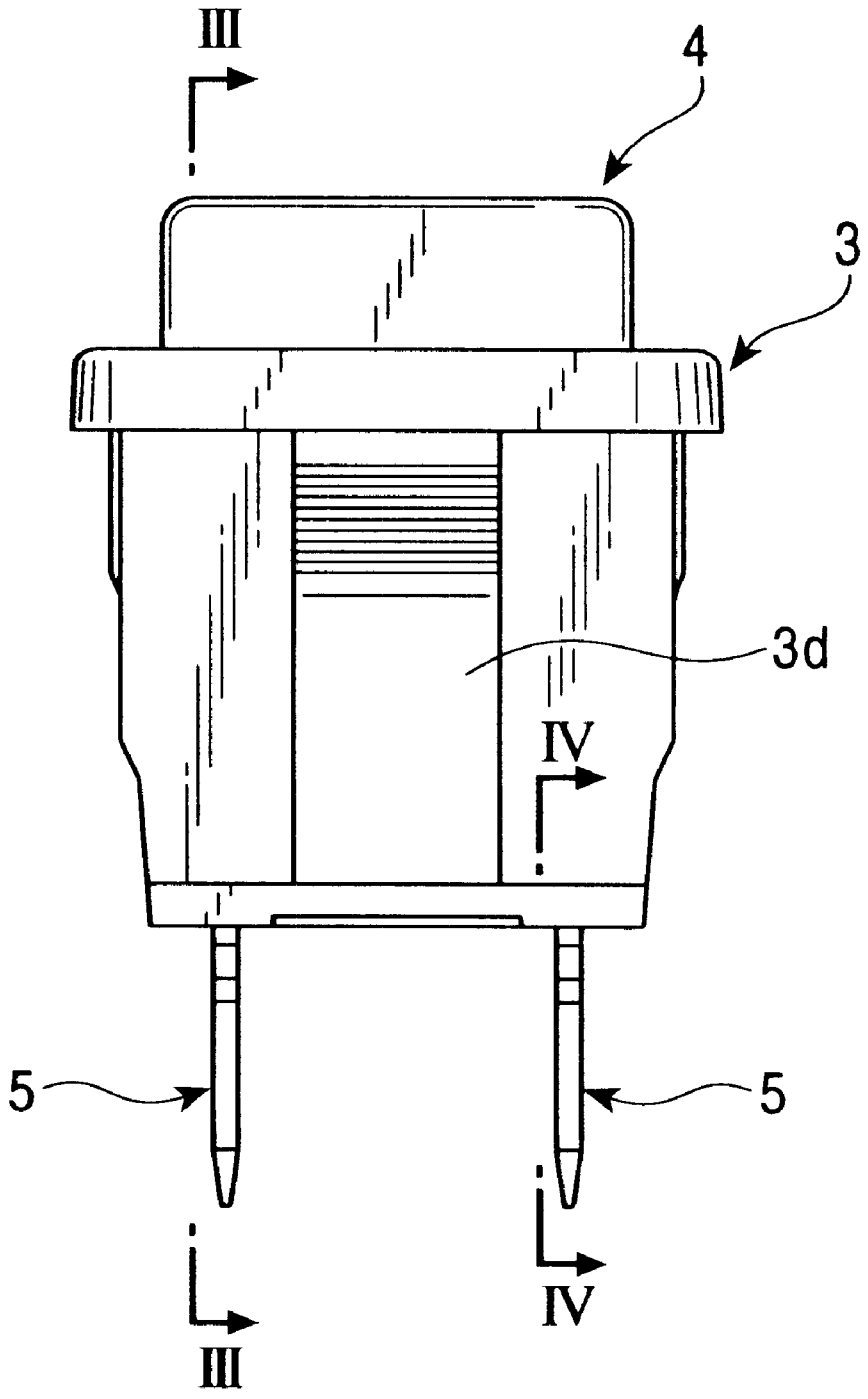
FIG. 2 is a side view of FIG. 1.

As shown in FIG. 6, presser grooves 3*f* are positioned in the lower end of a front exterior surface of the second case 3. As shown in FIG. 1, the presser grooves 3*f* are configured to press and inwardly bend dislodging-preventing pawls 5*c* and 6*c* after the stationary terminals 5 and 6 have been inserted through the holes 3*a* to prevent the stationary terminals 5 and 6 from becoming dislodged from the second case 3. Pawls 5*c* and 6*c* (shown in FIG. 3) are formed on the bottom surface of the second case 3. The pawls 5*c* and 6*c* are disposed in a row that is coupled with the presser grooves 3*f*.

As partially shown in FIG. 1, preferably, holes 3*g*, which rotatably support shafts 4*c* of the operating lever 4, are formed near the top end of the second surface of the outside of the second case 3. Preferably, operating lever 4 is made of an insulating material, such as synthetic resin. As partially shown in FIG. 12, preferably, the operating lever 4 comprises a substantially planar operating portion 4*a*, a rod-shaped actuating portion 4*b*, which couples to the lower surface of the operating portion 4*a*, and a pair of the shafts 4*c* which oppose each other near the center of a side surface of the operating lever 4. Preferably, the actuating portion 4*b* (shown in FIG. 12) is received by the pair of window holes 2*a* of the cover 2 (shown in FIG. 9). Preferably, shafts 4*c* are received by the holes 3*g* and are supported by the second case 3 through which the holes 3*g* pass or partially pass through (shown in FIG. 1).

Preferably, a pair of the stationary terminals 5 and 6 are disposed near the inside bottom portions of the first and second cases 1 and 3. Preferably, the pair of stationary terminals 5 and 6 are made of electrically conductive materials, and are substantially L-shaped. The first stationary contact 5*a*, with which a rotary contact portion 7*a* of the movable contact 7 engages, is preferably positioned near the top surface of the stationary terminal 5. The second stationary contact 6*a* is preferably positioned near the top surface of the stationary contact 6. In this preferred embodiment, the stationary contact 6*a* is normally coupled to contact portion 7*b*.

The preferred dimensions of the receiving holes 1*d* of the first case 1 are preferably greater than the widths of the stationary terminals 5 and 6. The preferred dimensions of the holes 3*a* of the second case 3 are preferably slightly smaller than the receiving holes 1*d*. Ends of the stationary terminals 5 and 6 at sides opposite to the corresponding stationary contacts 5*a* and 6*a*, respectively, pass through the receiving holes 1*d* of the first case 1. The ends of the stationary terminals 5 and 6 pass through the holes 3*a* of the second case 3 to press-fit and secure the first and second stationary contacts 5*a* and 6*a*, respectively, to the first and second cases 1 and 3.

As shown in FIG. 3, preferably cutaway portions 5*b* and 6*b* pass through the centers of the stationary terminals 5 and 6. The dislodging-preventing pawls 5*c* and 6*c* are received by the cutaway portions 5*b* and 6*b*, respectively. The pawls 5*c* and 6*c* are disposed near the corresponding presser grooves 3*f* of the second case 3 shown in FIG. 6. The pawls 5*c* and 6*c* are pressed, and are inwardly bent to engage the presser grooves 3*f* (shown in FIG. 1) and thereby prevent the stationary terminals 5 and 6 from becoming dislodged from the second case 3.

Referring now to FIG. 3, preferably, the movable contact 7 comprises an electrically conductive material. The rotary contact portion 7*a* which contacts and separates from the first stationary contact 5*a* is formed at a first end of the movable contact 7. The contact portion 7*b* which contacts the second stationary contact 6*a* is formed at a second end of the movable contact 7. Preferably, a coil spring 8 rotatably biases the movable contact 7 as shown in FIG. 3. Preferably, the coil spring 8 is disposed near the center of the movable contact 7. As lever 4 is depressed, the actuating portion 4*b* of the operating lever 4 preferably biases and rotates the coil spring 8, causing the movable contact 7 to rotate about the contact portion 7*b* like a fulcrum.

To assemble the preferred switch, the first case 1 is inserted into the second case 3. Preferably, the first case 1 is inserted into the bottom portion of the second case 3 such that the protrusion 3*c* engages the recess 1*f*. Preferably, the protruding step 3*b* of the second case 3 is received by the through holes 1*e* of the first case 1 (shown in FIG. 4). Preferably the stationary terminals 5 and 6 are press-fit or inserted into holes 3*a* of the second case 3 and through the receiving holes 1*d* of the first case 1 (partially shown in FIG. 4). Through this engagement, the stationary terminals 5 and 6 are secured to the first and second cases 1 and 3, respectively. Preferably, the stationary terminals 5 and 6 are secured to the second case 3 through a pressing jig. Preferably the pressing jig presses and bends the dislodging-preventing pawl 5*c* of the stationary terminal 5 and the dislodging-preventing pawl 6*c* of the stationary terminal 6.

Preferably, the movable contact 7 is disposed above the stationary terminals 5 and 6. In this embodiment, when the contact portion 7*b* is coupled or in contact with the second stationary contact 6*a*, the cover 2 is coupled to the top portion of the first case 1, which is inserted within and secured to the second case 3. The actuating portion 4*b* of the operating lever 4 is inserted through the window holes 2*a* of the cover 2. Preferably an end of the actuating portion 4*b* is in contact with the coil spring 8 which is disposed on the movable contact 7 when shafts 4*c* of the operating lever 4 engage the holes 3*g* of the second case.

According to the preferred embodiment, the switch device comprises a first case 1 and a second case 3. The first case 1 encloses the contacts 5*a,* 6*a,* and 7 within the first case 1. The cover 2 protects and seals the contacts 5*a,* 6*a,* and 7 from contaminants. Preferably, the engaging hook 3*d* and the stationary terminals 5 and 6 project from the second case which encloses the first case 1 and the cover 2. Preferably, the first case 1 and the cover 2 are made of resins having a high arc resistance.

Preferably, the second case 3 is made of a thermoplastic resin that is more flexible than the first case 1. The stationary terminals 5 and 6 are secured to the second case 3 by passing the stationary terminals 5 and 6 through the receiving holes 1*d* which pass through the inside bottom portion of the first case 1.

Preferably, the second case 3 is made of a thermoplastic resin. The thermoplastic resin preferably provides arc resistance between the contacts, and forms the engaging hook 3*d*. Preferably terminals 5 and 6 are secured to the first and second cases 1 and 3, respectively, making it unnecessary to separately bond terminals 5 & 6 to one or more cases using an adhesive. Moreover, to provide satisfactory arc resistance, the second case is preferably made of a thermosetting resin having a high arc resistance. Accordingly, the engaging hook 3*d*, in the preferred embodiment need not be made of a separate plate material.

Preferably, the first case 1 comprises accommodating portions 1*b* and 1*c* in which the first and second stationary contacts 5*a* and 6*a*, respectively, and the movable contact 7 are disposed. Preferably, the snap engaging hook 3*d* is a unitary part of or is coupled to the second case 3. The stationary terminals 5 and 6 project from the corresponding first and second stationary contacts 5*a* and 6*a*, respectively. The second case 3 preferably encloses the first case 1 and the cover 2. Preferably, the first case 1 and the cover 2 are made of resins having an arc resistance, and the second case 3 is made of a more flexible resin than the first case 1.

In the preferred embodiment, the stationary terminals 5 and 6 are press-fitted to the second case 3. The stationary terminals 5 and 6 pass through the receiving holes 1*d* that pass through the inner bottom portion of the first case 1. Preferably, a high arc resistance between the contacts is maintained. The stationary terminals 5 and 6 can be press-fitted to both the first and second cases 2 and 3. The preferred first and second case 2 and 3, respectively, and stationary terminals 5 and 6 make it unnecessary to separately bond the stationary terminals 5 and 6 to both the cases 2 and 3 using an adhesive. The contact section, which comprises the first and second stationary contacts 5*a* and 6*a*, respectively, and the movable contact 7, may be enclosed by the first case 1 and the cover 2 which are made of resins having high arc resistances.

An outside surface of the first case 1 and an inside surface of the second case 3 may include a preventing means. Preferably the preventing means prevents assembly in such a manner that the first case 1 is improperly inserted into the second case 3. In a preferred embodiment, the preventing means comprises a recess 1*f* which is provided on the outside surface of the first case 1, and a protrusion 3*c* which is positioned on the inner surface of the second case 3. In this preferred embodiment, the recess 1*f* and the protrusion 3*c* are positioned on the sides of the respective first case 1 and second case 3 having the shortest lengths of each respective case. The preventing means can be integrally coupled with or a unitary part of the first and second cases 1 and 3. When the first case 1 is improperly inserted into the second case 3, the recess and the protrusion 3*c* are not aligned and thus, do not engage each other. This improper assembly can be easily detected because the first case 1 does not substantially seat within the second case 2.

The switch device may further comprise protruding steps 3*b* that are positioned on the inner bottom surface of the second case 3. The protruding steps 3*b* are preferably disposed near the holes 3*a* that receive the stationary terminals 5 and 6 and project upward from the inner bottom surface of the second case 3. Through holes 1*e,* passing through the inner bottom portion of the first case 1, receive the protruding steps 3*b*. In the preferred switch device, the stationary terminals 5 and 6 may be positioned by bringing bottom surface portions of the stationary terminals 5 and 6 into contact with the protruding steps 3*b*. Preferably, the stationary terminals 5 and 6 are received and secured to the holes 3*a* of the second case 3. The first case 1 and the second case 3 may be positioned by fitting the protruding steps 3*b* within the through holes 1*e*. Accordingly, the cases 1 and 3 can be easily aligned, and the receiving holes 3*a* and 1*e* can be easily aligned.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A switch device comprising:

a first stationary contact;

a movable contact in switchable contact with the first stationary contact;

a first case enclosing the first stationary contact and the movable contact;

a cover having a window hole, the cover enclosing the first case;

an operating lever passing through the window hole, the operating lever contacting and being configured to actuate the movable contact when the operating lever is depressed;

a second case enclosing the first case and the cover, the second case having an engaging hook coupled to an outside surface of the second case;

a stationary terminal projecting from the first stationary contact and through the first and second case;

wherein the first case and the cover are made of an arc resistance resin;

wherein the second case is made of a thermoplastic resin that is more flexible than the first case; and wherein the first stationary terminal is secured to the first case through a receiving hole which is positioned in an inside bottom portion of the second case.

2. A switch device according to claim 1, wherein the first case and the cover conceal the first stationary contact and the movable contact.

3. A switch device according to claim 1, further comprising preventing means aligning the first case to the second case.

4. A switch device according to claim 3, wherein the preventing means comprises a recess positioned on the outside surface of the first case, and a protrusion positioned on an inside surface of the second case.

5. A switch device according to claim 1, further comprising a protruding step projecting from an inside bottom surface of the second case disposed near a hole within the second case configured to receive the stationary terminal, and a through hole, passing through an inside bottom portion of the first case, the through hole being configured to receive the protruding step, wherein the bottom surface portion of the stationary terminal is in contact with the projecting step.

6. A switch device according to claim 5, wherein the first case and the second case are coupled by passing the protruding step through the through hole.

* * * * *